US011111773B1

(12) United States Patent
Zeghlache

(10) Patent No.: US 11,111,773 B1
(45) Date of Patent: Sep. 7, 2021

(54) SYSTEMS AND METHODS FOR TESTING WELLBORE COMPLETION SYSTEMS

(71) Applicant: Saudi Arabian Oil Company, Dhahran (SA)

(72) Inventor: Mohamed Larbi Zeghlache, Al Khubar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/904,927

(22) Filed: Jun. 18, 2020

(51) Int. Cl.
*E21B 47/01* (2012.01)
*E21B 47/13* (2012.01)
*E21B 47/095* (2012.01)
*E21B 47/092* (2012.01)

(52) U.S. Cl.
CPC ..... *E21B 47/01* (2013.01); *E21B 47/092* (2020.05); *E21B 47/095* (2020.05); *E21B 47/13* (2020.05)

(58) Field of Classification Search
CPC ..... E21B 47/01; E21B 47/092; E21B 47/13; E21B 47/095
See application file for complete search history.

(56) References Cited

U.S. PATENT DOCUMENTS 2,563,254 A * 8/1951 Lewis ..... G01B 7/107 324/229
3,535,623 A * 10/1970 Wood ..... G01N 27/904 324/220
4,218,651 A * 8/1980 Ivy ..... E21B 17/006 324/151 R
4,258,318 A * 3/1981 Furukawa ..... G01N 27/9013 324/220
4,442,403 A * 4/1984 Pohler ..... G01N 27/9013 324/220
10,502,044 B2 12/2019 Fouda et al.
2009/0173504 A1* 7/2009 McElhinney ..... E21B 47/0228 166/380

(Continued)

FOREIGN PATENT DOCUMENTS

WO WO 2017196357 11/2017
WO WO 2018084865 5/2018

OTHER PUBLICATIONS

Pettitt-Schieber et al., "Testing Electromagnetic Multi-Pipe Thickness Tools in Azimuthally Constringed Defects for Deepwater Applications", Mar. 16, 2020, Society of Petroleum Engineers, SPE-199870-MS, 1-12. (Year: 2020).*

(Continued)

*Primary Examiner* — Caroline N Butcher
(74) *Attorney, Agent, or Firm* — Fish & Richardson P.C.

(57) ABSTRACT

Techniques for testing a wellbore tubular system include positioning a primary wellbore tubular that includes an inner volume on at least one fixed mount positioned to support the primary wellbore tubular; positioning a secondary wellbore tubular concentrically or eccentrically within at least a portion of the inner volume of the primary wellbore tubular; coupling the secondary wellbore tubular on an adjustable stand positioned to support the secondary wellbore tubular; running a logging tool within an inner volume of the secondary wellbore tubular; detecting at least one defect of at least one of the primary wellbore tubular or the secondary wellbore tubular; and moving the secondary wellbore tubular within the inner volume of the primary wellbore tubular on a roller of the at least one adjustable stand.

31 Claims, 5 Drawing Sheets

(56) References Cited

U.S. PATENT DOCUMENTS

| | | | | |
|---|---|---|---|---|
| 2015/0101798 | A1* | 4/2015 | Buytaert | E21B 17/1028 166/250.01 |
| 2015/0338541 | A1* | 11/2015 | Nichols | G01V 3/26 324/338 |
| 2016/0025961 | A1* | 1/2016 | Tripathy | G01N 21/954 348/84 |
| 2016/0168974 | A1 | 6/2016 | Donderici | |
| 2017/0101865 | A1 | 4/2017 | Khalaj Amineh et al. | |
| 2018/0371886 | A1 | 12/2018 | Zeghlache et al. | |
| 2019/0040734 | A1 | 2/2019 | Donderici et al. | |

OTHER PUBLICATIONS

Al Macki et al., "Electromagnetic Corrosion Logs, Insights from Yard Test," SPE-188672-MS, Society of Petroleum Engineers, presented at the Abu Dhabi International Petroleum Exhibition and Conference in Abu Dhabi, UAE, Nov. 13-16, 2017, 9 pages.

Garcia et al., "Successful Application of a New Electromagnetic Corrosion Tool for Well Integrity Evaluation in Old Wells Complete with Reduced Diameter Tubular," IPTC.16997, International Petroleum Technology Conference, Beijing, China, Mar. 26-28, 2013, 12 pages.

Gardner et al., "Barrier Verification During Plug and Abandonment Using Spectral Noise Logging Technology, Reference Cells Yard Test," Society of Petroleum Engineers, SPE/IADC-194075-MS, SPE/IASDC Drilling International Conference and Exhibition in the Hague, the Netherlands, Mar. 5-7, 2019, 22 pages.

Pettitt-Schieber et al., "Testing Electromagnetic Multi-Pipe Thickness Tools in Azimuthally Constrained Defects for Deepwater Applications," Society of Petroleum Engineers, SPE-199870-MS, official proceedings for SPE/ICoTA Well Intervention Conference and Exhibition, Mar. 16, 2020, 12 pages.

* cited by examiner

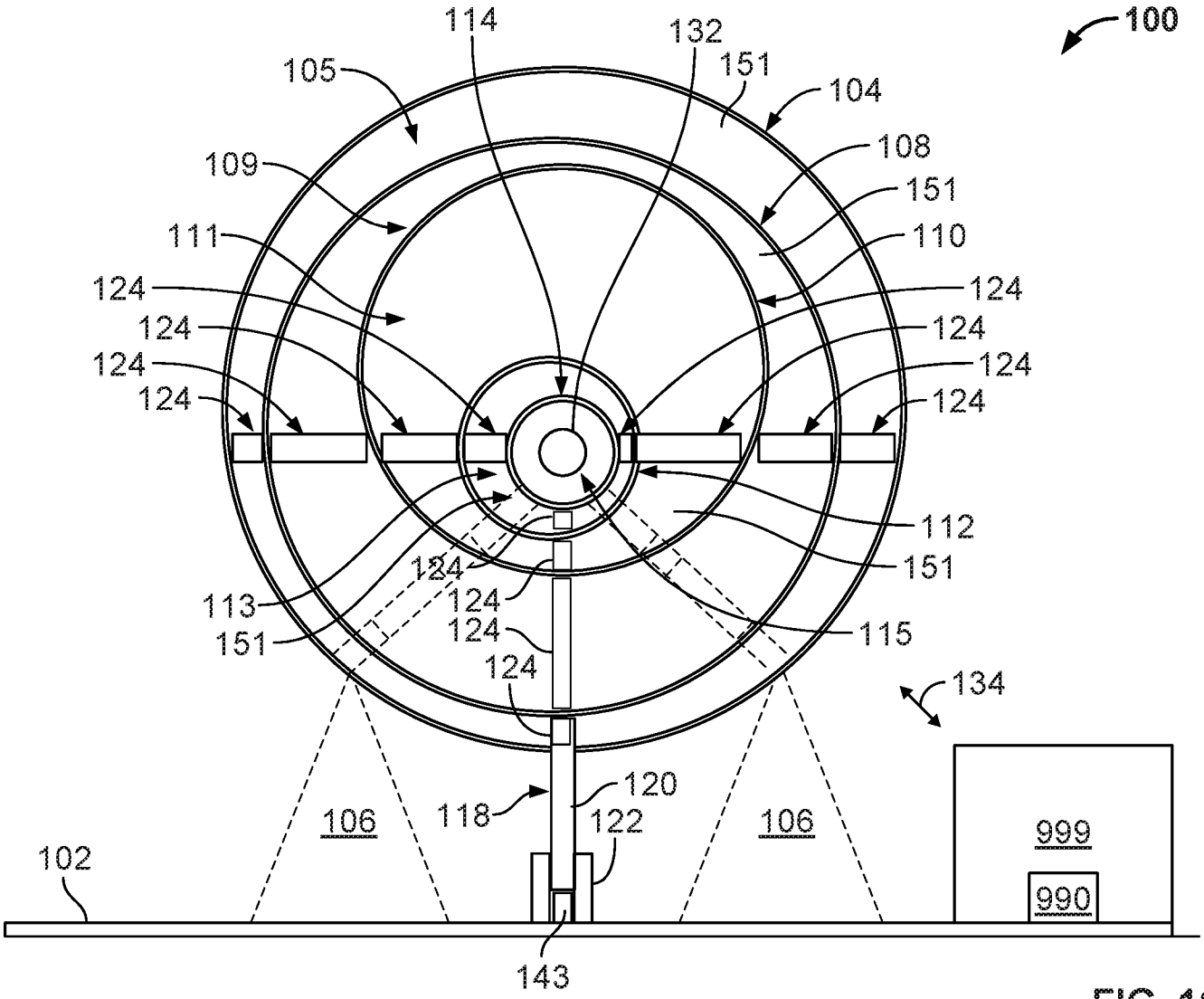
100
104
105
106
106
108
109
110
111
112
113
114
115
118
120
122
124
124
124

SYSTEMS AND METHODS FOR TESTING WELLBORE COMPLETION SYSTEMS

TECHNICAL FIELD

This disclosure relates to systems and method for testing wellbore completion systems and, more particularly, systems and methods for testing wellbore completion systems with an above-ground modular testing system.

BACKGROUND

Wellbore tubular and cement integrity, which impacts well integrity as a whole, is a priority and has an impact on health, safety, and environment (HSE) and efficiency in oil and gas fields. Conventionally, downhole tools, such as electromagnetic (EM) logging tools, are run into a wellbore to detect potential defects in one or more wellbore tubulars positioned in the wellbore. Such tools, in some aspects, may not detect all defects in the cases of multiple, concentric wellbore tubulars positioned in the wellbore. Similarly, tubing cement logging (for example, through or multiple cement sheath) may not be able to detect all features and defects in wellbore downhole conditions.

SUMMARY

This disclosure describes systems and methods for testing one or more wellbore tubulars for defects (for example, corrosion, cement, jewelries or otherwise) with a modular testing system. In some aspects, the modular testing system includes a fixed wellbore tubular that is mounted in a stationary position on a support surface as well as multiple adjustable wellbore tubulars that are concentrically or eccentrically nested (at least partially) within the fixed wellbore tubular. The adjustable wellbore tubulars may be rotated, linearly and laterally moved (or all) to vary a nesting configuration. For example, a logging tool may be inserted through at least one of the adjustable wellbore tubulars to detect one or more defects formed on one or more of the fixed wellbore tubular or the adjustable wellbore tubulars.

In an example implementation, a modular testing system includes a primary wellbore tubular that includes at least one open end and an inner volume; at least one fixed mount configured to couple to the primary wellbore tubular and support the primary wellbore tubular on a support surface in a fixed position against movement relative to the support surface; at least one secondary wellbore tubular sized to fit within the inner volume of the primary wellbore tubular; at least one adjustable stand configured to couple to the at least one secondary wellbore tubular and support the at least one secondary wellbore tubular on the support surface, and a logging tool positionable within an inner volume of the at least one secondary wellbore tubular and configured to detect at least one defect of at least one of the primary wellbore tubular or the at least one secondary wellbore tubular. The at least one adjustable stand includes a roller coupled to an end of the at least one adjustable stand and configured to move the at least one secondary wellbore tubular through the inner volume of the primary wellbore tubular.

An aspect combinable with the example implementation further includes at least one wheel positionable to contact an inner surface of the primary wellbore tubular and an outer surface of the at least one secondary wellbore tubular.

In another aspect combinable with any of the previous aspects, the at least one wheel is configured to move the at least one secondary wellbore tubular through the inner volume of the primary wellbore tubular.

In another aspect combinable with any of the previous aspects, the at least one adjustable stand is coupled to the at least one secondary wellbore tubular at or near a first open end of the at least one secondary wellbore tubular.

In another aspect combinable with any of the previous aspects, the at least one wheel contacts the at least one secondary wellbore tubular at or near a second open end of the at least one secondary wellbore tubular opposite the first open end.

In another aspect combinable with any of the previous aspects, the at least one secondary wellbore tubular includes a first secondary wellbore tubular and a second secondary wellbore tubular.

In another aspect combinable with any of the previous aspects, the at least one adjustable stand includes a first adjustable stand having a first roller and a second adjustable stand having a second roller.

In another aspect combinable with any of the previous aspects, the first secondary wellbore tubular is sized to fit within the inner volume of the primary wellbore tubular, and the second secondary wellbore tubular is sized to fit within an inner volume of the first secondary tubular.

In another aspect combinable with any of the previous aspects, the logging tool is positionable within the inner volume of the second secondary wellbore tubular and is configured to detect at least one defect of at least one of the primary wellbore tubular, the first secondary wellbore tubular, or the second secondary wellbore tubular.

In another aspect combinable with any of the previous aspects, the second roller of the second adjustable stand is configured to move the second secondary wellbore tubular through the inner volume of the first secondary wellbore tubular.

Another aspect combinable with any of the previous aspects further includes a first wheel positionable to contact an inner surface of the primary wellbore tubular and an outer surface of the first secondary wellbore tubular, the first wheel configured to move the first secondary wellbore tubular through the inner volume of the primary wellbore tubular; and a second wheel positionable to contact an inner surface of the first secondary wellbore tubular and an outer surface of the second secondary wellbore tubular, the second wheel configured to move the second secondary wellbore tubular through the inner volumes of the first secondary wellbore tubular and the primary wellbore tubular.

In another aspect combinable with any of the previous aspects, the first wheel includes a plurality of first wheels positionable to contact the inner surface of the primary wellbore tubular and the outer surface of the first secondary wellbore tubular and sized to radially center the first secondary wellbore tubular within the inner volume of the primary wellbore tubular.

In another aspect combinable with any of the previous aspects, the second wheel includes a plurality of second wheels positionable to contact the inner surface of the first secondary wellbore tubular and the outer surface of the second secondary wellbore tubular and sized to radially center the second secondary wellbore tubular within the inner volume of the primary wellbore tubular and the first secondary wellbore tubular.

In another aspect combinable with any of the previous aspects, the at least one adjustable stand includes a structural member coupled to the roller and the at least one secondary wellbore tubular, the structural member having an adjustable length.

In another example implementation, a method for testing a wellbore tubular system includes positioning a primary wellbore tubular that includes at least one open end and an inner volume on at least one fixed mount positioned to support the primary wellbore tubular on a support surface in a fixed position against movement relative to the support surface; positioning at least one secondary wellbore tubular concentrically or eccentrically within at least a portion of the inner volume of the primary wellbore tubular; coupling the at least one secondary wellbore tubular on at least one adjustable stand positioned to support the at least one secondary wellbore tubular on the support surface; running a logging tool within an inner volume of the at least one secondary wellbore tubular; detecting at least one defect of at least one of the primary wellbore tubular or the at least one secondary wellbore tubular; and moving the at least one secondary wellbore tubular within the inner volume of the primary wellbore tubular on a roller of the at least one adjustable stand that is in contact with the support surface.

An aspect combinable with the example implementation further includes moving the at least one secondary wellbore tubular through the inner volume of the primary wellbore tubular on at least one wheel positioned to contact an inner surface of the primary wellbore tubular and an outer surface of the at least one secondary wellbore tubular.

Another aspect combinable with any of the previous aspects further includes rotating the at least one secondary wellbore tubular within the inner volume of the primary wellbore tubular on the roller and the at least one wheel.

In another aspect combinable with any of the previous aspects, the at least one secondary wellbore tubular includes a first secondary wellbore tubular and a second secondary wellbore tubular, and the at least one adjustable stand includes a first adjustable stand having a first roller and a second adjustable stand having a second roller.

In another aspect combinable with any of the previous aspects, moving the at least one secondary wellbore tubular within the inner volume of the primary wellbore tubular includes at least one of moving the first secondary wellbore tubular within the inner volume of the primary wellbore tubular on the first roller of the first adjustable stand; or moving the second secondary wellbore tubular within the inner volume of the primary wellbore tubular and an inner volume of the first secondary wellbore tubular on the second roller of the second adjustable stand.

Another aspect combinable with any of the previous aspects further includes, simultaneously moving the first secondary wellbore tubular within the inner volume of the primary wellbore tubular on the first roller of the first adjustable stand; and moving the second secondary wellbore tubular within the inner volume of the primary wellbore tubular and an inner volume of the first secondary wellbore tubular on the second roller of the second adjustable stand.

Another aspect combinable with any of the previous aspects further includes running the logging tool within an inner volume of the second secondary wellbore tubular; and detecting at least one defect of at least one of the primary wellbore tubular, the first secondary wellbore tubular, or the second secondary wellbore tubular.

Another aspect combinable with any of the previous aspects further includes moving the first secondary wellbore tubular through the inner volume of the primary wellbore tubular on a first wheel positioned to contact an inner surface of the primary wellbore tubular and an outer surface of the first secondary wellbore tubular; and moving the second secondary wellbore tubular through the inner volume of the primary wellbore tubular and an inner volume of the first secondary wellbore tubular on a second wheel positioned to contact an inner surface of the first secondary wellbore tubular and an outer surface of the second secondary wellbore tubular.

In another aspect combinable with any of the previous aspects, the first wheel includes a plurality of first wheels and the second wheel includes a plurality of second wheels.

Another aspect combinable with any of the previous aspects further includes radially centering the first secondary wellbore tubular within the inner volume of the primary wellbore tubular on the plurality of first wheels; and radially centering the second secondary wellbore tubular within the inner volumes of the first secondary wellbore tubular and the primary wellbore tubular on the plurality of second wheels.

In another aspect combinable with any of the previous aspects, the first wheel includes a plurality of first wheels and the second wheel includes a plurality of second wheels.

Another aspect combinable with any of the previous aspects further includes eccentrically positioning the first secondary wellbore tubular within the inner volume of the primary wellbore tubular on the plurality of first wheels; and eccentrically positioning the second secondary wellbore tubular within the inner volumes of the first secondary wellbore tubular and the primary wellbore tubular on the plurality of second wheels.

Another aspect combinable with any of the previous aspects further includes at least one of installing a hardenable material in an annular space between the primary wellbore tubular and the first secondary wellbore tubular; or installing the hardenable material in an annular space between the first secondary wellbore tubular and the second secondary wellbore tubular.

Another aspect combinable with any of the previous aspects further includes running the logging tool within an inner volume of the second secondary wellbore tubular; and detecting at least one defect in at least one of the hardenable material installed in the annular space between the primary wellbore tubular and the first secondary wellbore tubular or the hardenable material installed in the annular space between the first secondary wellbore tubular and the second secondary wellbore tubular.

Another aspect combinable with any of the previous aspects further includes adjusting a height of the at least one adjustable stand to adjust a distance between the at least one secondary wellbore tubular and the support surface.

In another example implementation, a wellbore tubular testing system includes a plurality of wellbore tubulars positioned in a nested configuration; a stationary mount positioned in contact with a particular one of the plurality of wellbore tubulars and supported by a support surface in a fixed position; at least one moveable mount positioned in contact with each of the other wellbore tubulars in the plurality of wellbore tubulars exclusive of the particular one of the plurality of wellbore tubulars, where each moveable mount is configured to move on the support surface to adjust a position of one of the other wellbore tubulars relative to the other wellbore tubulars; a logging tool positionable within an innermost one of the plurality of wellbore tubulars in the nested configuration; and a control system communicably coupled to the logging tool and configured to perform operations. The operations include receiving at least one measurement from the logging tool as the logging tool moves within the innermost one of the plurality of wellbore tubulars in the nested configuration; and based on the at least one measurement, characterizing at least one defect formed on at least one of the plurality of wellbore tubulars.

In an aspect combinable with the example implementation, the nested configuration includes a first nested configuration.

In another aspect combinable with any of the previous aspects, the control system is configured to perform operations further including receiving at least another measurement from the logging tool as the logging tool moves within the innermost one of the plurality of wellbore tubulars in a second nested configuration different than the first nested configuration; and based on the at least another measurement, characterizing at least another defect formed on at least one of the plurality of wellbore tubulars.

In another aspect combinable with any of the previous aspects, the at least one measurement includes at least one of: electromagnetic, magnetic, sonic, ultrasonic, mechanical, or temperature.

In another aspect combinable with any of the previous aspects, the at least one defect includes at least one of a longitudinal crack, a transverse crack, a hole or pinhole, corrosion, or metal loss.

In another aspect combinable with any of the previous aspects, the operation of receiving the at least one measurement from the logging tool as the logging tool moves within the innermost one of the plurality of wellbore tubulars in the nested configuration includes receiving at least one measurement from the logging tool as the logging tool moves within the innermost one of the plurality of wellbore tubulars for each of a plurality of unique nested configurations.

In another aspect combinable with any of the previous aspects, the operation of characterizing the at least one defect formed on at least one of the plurality of wellbore tubulars includes characterizing at least one defect formed on at least one of the plurality of wellbore tubulars based on the at least one measurement from the logging tool as the logging tool moves within the innermost one of the plurality of wellbore tubulars for each of the plurality of unique nested configurations.

In another aspect combinable with any of the previous aspects, the control system is configured to perform operations further including generating a machine learning model based on the at least one measurement for each of the plurality of unique nested configurations and the characterized at least one defect for each of the plurality of unique nested configurations.

In another aspect combinable with any of the previous aspects, the control system is configured to perform operations further including receiving at least one logging measurement from a wellbore tubular system formed in a wellbore from a terranean surface to a subterranean formation, the wellbore tubular system including a plurality of wellbore tubulars; and using the machine learning model, characterizing one or more defects in the wellbore tubular system based on the at least one logging measurement.

In another aspect combinable with any of the previous aspects, at least one of the plurality of wellbore tubulars is positioned eccentrically relative to at least another one of the plurality of wellbore tubulars in the nested configuration.

Implementations of a modular testing system according to the present disclosure may also include one or more of the following features. For example, a modular testing system may replicate most common well completions and types of wellbore tubular defects to properly characterize any new technology log response and help in a pre-qualification phase of any downhole sensor, downhole equipment, or intervention method. As another example, the modular testing system may facilitate testing, validation, calibration, pre/post acquisition verification, characterization and qualification of any combination of wellbore tubulars, wellbore tubular sensors, or deployment/intervention technique. As a further example, a modular testing system according to the present disclosure may reduce a sensor response uncertainty in downhole conditions of new technologies for detecting tubular defects, such as EM logging technology. As another example, a modular testing system according to the present disclosure may provide for a reduction in costs and an increase in service quality by facilitating pre-qualification and improving competition among different technology and services for wellbore tubular defect detection and cement evaluation. Further, a modular testing system according to the present disclosure may optimize resources by using a field constructed surface modular system instead of a downhole testing system, which requires candidate wells, mobilization to and at a wellsite, and rig time for technology assessment. As a further example, a modular testing system according to the present disclosure may provide trustable data to ensure a proper decision-making process in executing well integrity and assets management strategies.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

FIGS. 1A-1C are schematic diagrams of a side view, end view, and end view, respectively of example implementations of a modular testing system according to the present disclosure.

DETAILED DESCRIPTION

Figure 1A:
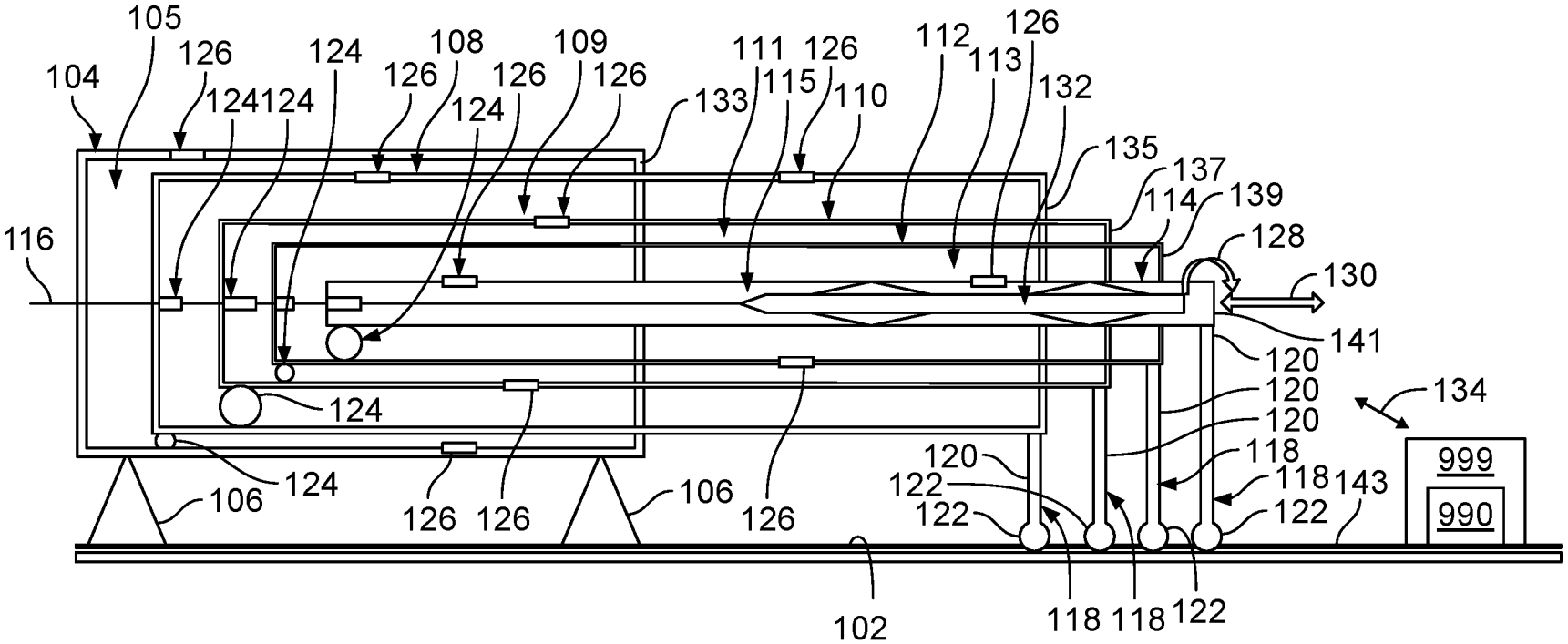
Figure 1B:
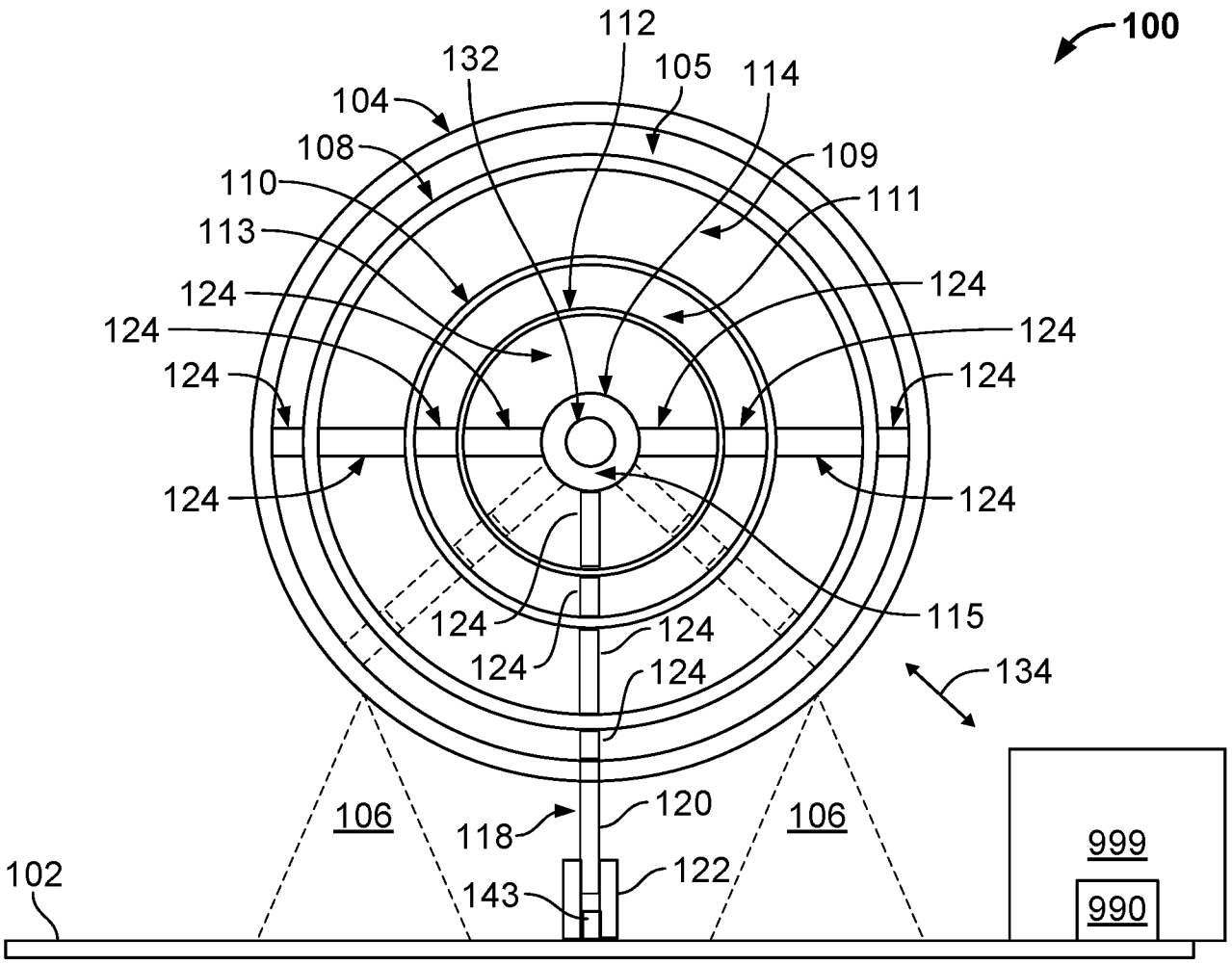

FIGS. 1A-1B are schematic diagrams of a side and end view, respectively of an example implementation of a modular testing system 100 according to the present disclosure. As shown in these figures, the modular testing system 100 is positioned on a support surface 102 (for example, the Earth's surface or a constructed surface supported by the Earth's surface). Although the term "support surface" is used, reference 102 may refer to any surface, such as a man-made platform (whether mounted on the Earth's surface or otherwise), slab, building floor surface, or other substantially planar surface that is immobile relative to the modular testing system 100.

Generally, the modular testing system 100 includes multiple, concentrically or eccentrically positioned (for example, nested with one within another and so on) wellbore tubulars, some of which may be moved (for example, linearly into and out of other wellbore tubulars, laterally to centered and decentered position or angularly within other wellbore tubulars) to simulate a downhole completion design of wellbore tubulars. In some aspects according to the present disclosure, a wellbore tubular may be or represent a particular casing, joint of drill string or production string or other workstring commonly run into a wellbore, a wellbore liner, or other form of conduit (often steel or a nonmetallic material, such as fiberglass and plastic) that is positioned and used within a wellbore to produce a hydrocarbon or other fluid from a subterranean formation. Thus, reference to a wellbore tubular can refer to a type of wellbore casing, joint of a workstring, liner, or other tubular.

Wellbore completion designs often have concentrically positioned wellbore tubulars, such that a smaller diameter tubular is positioned within a larger diameter tubular, which is positioned within another larger diameter tubular, and so on. For example, one or more casings (for example, surface casings, conductor casings, intermediate casings, production casings) may be positioned in a wellbore formed from a terranean surface to a subterranean formation. The casings, in some aspects, may be positioned in series or may, in some places, overlap (for example, concentrically). Other wellbore tubulars may be positioned in the wellbore within the casing(s). For example, a wellbore liner hung from a liner hanger may be positioned concentrically inside the casing(s). A production string made of multiple joints of production tubing (for example, threaded together to form the string) may be positioned concentrically within the wellbore liner.

Each of the aforementioned wellbore tubulars, when positioned in the wellbore, may develop one or more defects. Such defects include, for example, corrosion that may weaken or damage a portion of the tubular, thereby affecting a structural integrity of the tubular. Other defects include, for example, longitudinal and transverse cracks, holes and pinholes, other generalized corrosion, or different degrees of internal and external metal loss (for example, square drill shape of specific width and depth in the tubular). Conventional testing to determine such defects and the extent of such defects often requires a logging tool (for example, EM logging tool) to be run into the wellbore or for the wellbore tubulars to be removed from the wellbore for inspection.

As shown in FIGS. 1A-1B, the modular testing system 100 replicates a wellbore tubular system that is positioned in a wellbore by including multiple wellbore tubulars concentrically positioned. For example, a primary wellbore tubular 104 is positioned on one or more fixed mounts 106 that rest on the support surface 102. In some aspects, the fixed mounts 106 are coupled to (for example, rigidly attached) to the primary wellbore tubular 104 to prevent or substantially prevent movement of the primary wellbore tubular 104 relative to the support surface 102. Movement of the primary wellbore tubular 104 may include linear movement (for instance left or right movement in the side view of FIG. 1A) or rotation relative to the support surface 102. The primary wellbore tubular 104, in some aspects, is or replicates a conductor casing, such as a landing base or an uphole-most casing positioned in a wellbore from a terranean surface. The fixed mounts 106, in some aspects, are formed from a non-conductive material (in other words, does not conduct electricity or EM energy) so as not to interfere with the operation of logging tool 132 (as explained in more detail later). In some aspects, the primary wellbore tubular 104 may have at least one open end 133 that allows the primary wellbore tubular 104 to receive one or more additional wellbore tubulars therewithin.

For example, as shown in FIGS. 1A-1B, concentrically placed within an inner volume 105 of the primary wellbore tubular 104 is a secondary wellbore tubular 108. In some aspects, the secondary wellbore tubular 108 is or replicates a casing placed downhole of a conductor casing, such as a surface casing. As shown in this example, the secondary wellbore tubular 108 is radially centered in the inner volume 105 of the primary wellbore tubular 104 by one or more wheels 124 that are positioned to contact both the primary wellbore tubular 104 (for example, an inner surface of the primary wellbore tubular 104) and the secondary wellbore tubular 108 (for example, an outer surface of the secondary wellbore tubular 108). Turning to FIG. 1B specifically, in this example implementation, three wheels 124 (spaced radially at 90° apart) are positioned to contact both the primary wellbore tubular 104 and the secondary wellbore tubular 108. However, more wheels 124 may be used, or the wheels 124 may be positioned in different places, as FIG. 1B shows (in dashed line) different possible locations of the wheels 124 that separate the primary wellbore tubular 104 and the secondary wellbore tubular 108.

The wheels 124, in this example, are sized to radially center (for example, on centerline 116) the secondary wellbore tubular 108 in the inner volume 105 (for example, to mimic a downhole configuration of such tubulars in a wellbore) as well as facilitate movement (for example, linear movement 130 of the secondary wellbore tubular 108 into and out of the inner volume 105, as well as rotation 128 of the secondary wellbore tubular 108 within the inner volume 105) of the secondary wellbore tubular 108. In some aspects, each of the wheels 124 that separate the primary wellbore tubular 104 from the secondary wellbore tubular 108 may be made from a non-conductive material as well.

Turning briefly to FIG. 1C, this figure shows an alternative implementation of the modular testing system 100 in which one or more of the secondary wellbore tubulars 108, 110, 112, or 114 are eccentrically positioned within the inner volume 105 of the primary wellbore tubular 104. For example, in the implementation of FIG. 1B, the secondary wellbore tubulars 108, 110, 112, and 114 are concentrically positioned in the inner volume 105; in other words, each of the radial centerlines of the secondary wellbore tubulars 108, 110, 112, and 114 is aligned with the centerline 116. Thus, a particular nested configuration of the modular testing system 100 shown in FIG. 1B is of a concentrically nested configuration. In FIG. 1C, one or more of the secondary wellbore tubulars 108, 110, 112, or 114 are eccentrically positioned within the inner volume 105; in other words, one or more of the radial centerlines of the secondary wellbore tubulars 108, 110, 112, or 114 is misaligned with the centerline 116. Thus, another particular nested configuration of the modular testing system 100 shown in FIG. 1C is of an eccentrically nested configuration. In some aspects, changing from a particular nested configuration to another nested configuration includes changing from a concentric nested configuration to an eccentric nested configuration (or vice versa).

In some aspects, eccentrically positioning one or more of the secondary wellbore tubulars 108, 110, 112, or 114 within the inner volume 105 includes using differently-sized alignment wheels 124 to separate a particular wellbore tubular from another wellbore tubular. For example, as shown in FIG. 1C, three alignment wheels 124 spaced radially at 90° apart, separate each particular wellbore tubular from an adjacent wellbore tubular. In this example, the eccentricity of, for example, secondary wellbore tubular 112 relative to secondary wellbore tubular 114 is formed by using different sized alignment wheels 124 in the set of three alignment wheels 124 that contactingly separate secondary wellbore tubular 112 from secondary wellbore tubular 114. In some aspects of the implementation shown in FIG. 1C, more wheels 124 may be used, or the wheels 124 may be positioned in different places, as FIG. 1C shows (in dashed line) different possible locations of the wheels 124 that separate adjacent wellbore tubulars. In a concentric nested configuration, such as is shown in FIG. 1B, each of three alignment wheels 124 that separate a particular wellbore tubular from another wellbore tubular may be identical (or substantially identical) in size to radially center the particular wellbore tubular with the another wellbore tubular. In some aspects, smaller sized alignment wheels 124 may be used in order to mimic tubular eccentricity in horizontal wellbore systems by mimicking an eccentricity due to gravity that leads to poor centralization of nested wellbore tubulars.

As further shown in FIG. 1C, cement 151 (or other hardenable material) may be positioned between adjacent secondary wellbore tubulars. For example, as shown, cement 151 is positioned: within all or part of inner volume 105 between the primary wellbore tubular 104 and the secondary wellbore tubular 108, within all or part of inner volume 109 between the secondary wellbore tubular 108 and the secondary wellbore tubular 110, within all or part of inner volume 111 between the secondary wellbore tubular 110 and the secondary wellbore tubular 112, and within all or part of inner volume 113 between the secondary wellbore tubular 112 and the secondary wellbore tubular 114. Thus, in some aspects, measurements taken by logging tool 132 may also take measurements to characterize one or more defects 126 that are formed in one or more portions of the cement 151 (such as cracks, thin layers, holes, and other defects). Although not expressly shown in FIG. 1B, the cement 151 may also be installed or positioned between any pair of adjacent wellbore tubulars as well.

As shown in FIGS. 1A-1C, in some implementations, instead of wheels 124, reduced friction rings may encircle each of the particular secondary wellbore tubulars and function to separate adjacent tubulars (to allow movement therebetween) and radially center the secondary wellbore tubulars on the centerline 116. In some implementations, according to the present disclosure, a "wheel" may include a spherical roller, wheel that allows for two degrees of freedom of movement, or other rounded member that allows a particular tubular to move relative to an adjacent tubular.

As shown in FIG. 1A (and shown in dashed line in FIG. 1B), an adjustable mount 118 is positioned to support the secondary wellbore tubular 108 on the support surface 102 at an open end 135 of the secondary wellbore tubular 108. In some aspects, the adjustable mount 118 includes a structural member 120 coupled to the secondary wellbore tubular 108 and a roller 122 coupled to the structural member 120. The structural member 120 may be coupled to the secondary wellbore tubular 108 to facilitate rotation 128 of the secondary wellbore tubular 108 about the centerline 116 of the modular testing system 100. The roller 122 may also facilitate linear movement 130 of the secondary wellbore tubular 108 into and out of the inner volume 105 of the primary wellbore tubular 104. In some aspects, the adjustable mount 118 that supports the secondary wellbore tubular 108 on the support surface 102 may be made of non-conductive material as well. In some aspects, movement of the secondary wellbore tubular 108 may be actuated by a human operator or a machine, such as a forklift or other machine.

As further shown in FIGS. 1A-1B, concentrically placed within an inner volume 109 of the secondary wellbore tubular 108 (as well as the inner volume 105 of the primary wellbore tubular 104) is another secondary wellbore tubular 110. In some aspects, the secondary wellbore tubular 110 is or replicates a casing placed downhole of a surface casing, such as an intermediate casing. As shown in this example, the secondary wellbore tubular 110 is radially centered in the inner volume 109 of the secondary wellbore tubular 108 by one or more wheels 124 that are positioned to contact both the secondary wellbore tubular 108 (for example, an inner surface of the secondary wellbore tubular 108) and the secondary wellbore tubular 110 (for example, an outer surface of the secondary wellbore tubular 110). Turning to FIG. 1B specifically, in this example implementation, three wheels 124 (spaced radially at 90° apart) are positioned to contact both the secondary wellbore tubular 108 and the secondary wellbore tubular 110. However, more wheels 124 may be used, or the wheels 124 may be positioned in different places, as FIG. 1B shows (in dashed line) different possible locations of the wheels 124 that separate the secondary wellbore tubular 108 and the secondary wellbore tubular 110.

The wheels 124, in this example, are sized to radially center (for example, on centerline 116) the secondary wellbore tubular 110 in the inner volume 109 (for example, to mimic a downhole configuration of such tubulars in a wellbore) as well as facilitate movement (for example, linear movement 130 of the secondary wellbore tubular 110 into and out of the inner volume 109, as well as rotation 128 of the secondary wellbore tubular 110 within the inner volume 109) of the secondary wellbore tubular 110. In some aspects, each of the wheels 124 that separate the secondary wellbore tubular 108 from the secondary wellbore tubular 110 may be made from a non-conductive material as well.

Turning to FIG. 1C, the alignment wheels 124, in this example, are sized to radially misalign the secondary wellbore tubular 110 in the inner volume 109 as well as facilitate movement (for example, linear movement 130 of the secondary wellbore tubular 110 into and out of the inner volume 109, as well as rotation 128 of the secondary wellbore tubular 110 within the inner volume 109) of the secondary wellbore tubular 110. In some aspects, each of the wheels 124 that separate the secondary wellbore tubular 108 from the secondary wellbore tubular 110 in FIG. 1C may be made from a non-conductive material as well.

As shown in FIG. 1A (and shown in dashed line in FIG. 1B), an adjustable mount 118 is positioned to support the secondary wellbore tubular 110 on the support surface 102 at an open end 137 of the secondary wellbore tubular 110. In some aspects, the adjustable mount 118 includes a structural member 120 coupled to the secondary wellbore tubular 110 and a roller 122 coupled to the structural member 120. The structural member 120 may be coupled to the secondary wellbore tubular 110 to facilitate rotation 128 of the secondary wellbore tubular 110 about the centerline 116 of the modular testing system 100. The roller 122 may also facilitate linear movement 130 of the secondary wellbore tubular 110 into and out of the inner volume 105 of the primary wellbore tubular 104. In some aspects, the adjustable mount 118 that supports the secondary wellbore tubular 110 on the support surface 102 may be made of non-conductive material as well. In some aspects, movement of the secondary wellbore tubular 110 may be actuated by a human operator or a machine, such as a forklift or other machine.

As further shown in FIGS. 1A-1B, concentrically placed within an inner volume 111 of the secondary wellbore tubular 110 (as well as the inner volumes 105 and 109) is another secondary wellbore tubular 112. In some aspects, the secondary wellbore tubular 112 is or replicates a casing placed downhole of an intermediate casing, such as a production casing. As shown in this example, the secondary wellbore tubular 112 is radially centered in the inner volume 111 of the secondary wellbore tubular 110 by one or more wheels 124 that are positioned to contact both the secondary wellbore tubular 110 (for example, an inner surface of the secondary wellbore tubular 110) and the secondary wellbore tubular 112 (for example, an outer surface of the secondary wellbore tubular 112). Turning to FIG. 1B specifically, in this example implementation, three wheels 124 (spaced radially at 90° apart) are positioned to contact both the secondary wellbore tubular 110 and the secondary wellbore tubular 112. However, more wheels 124 may be used, or the wheels 124 may be positioned in different places, as FIG. 1B shows (in dashed line) different possible locations of the wheels 124 that separate the secondary wellbore tubular 110 and the secondary wellbore tubular 112.

The wheels 124, in this example, are sized to radially center (for example, on centerline 116) the secondary wellbore tubular 112 in the inner volume 111 (for example, to mimic a downhole configuration of such tubulars in a wellbore) as well as facilitate movement (for example, linear movement 130 of the secondary wellbore tubular 112 into and out of the inner volumes 105 and 109, as well as rotation 128 of the secondary wellbore tubular 112 within the inner volume 111) of the secondary wellbore tubular 112. In some aspects, each of the wheels 124 that separate the secondary wellbore tubular 110 from the secondary wellbore tubular 112 may be made from a non-conductive material as well.

Turning to FIG. 1C, the alignment wheels 124, in this example, are sized to radially misalign the secondary wellbore tubular 112 in the inner volume 111 as well as facilitate movement (for example, linear movement 130 of the secondary wellbore tubular 112 into and out of the inner volumes 105 and 109, as well as rotation 128 of the secondary wellbore tubular 110 within the inner volume 111) of the secondary wellbore tubular 112. In some aspects, each of the wheels 124 that separate the secondary wellbore tubular 110 from the secondary wellbore tubular 112 in FIG. 1C may be made from a non-conductive material as well.

As shown in FIG. 1A (and shown in dashed line in FIG. 1B), an adjustable mount 118 is positioned to support the secondary wellbore tubular 112 on the support surface 102 at an open end 139 of the secondary wellbore tubular 112. In some aspects, the adjustable mount 118 includes a structural member 120 coupled to the secondary wellbore tubular 110 and a roller 122 coupled to the structural member 120. The structural member 120 may be coupled to the secondary wellbore tubular 112 to facilitate rotation 128 of the secondary wellbore tubular 112 about the centerline 116 of the modular testing system 100. The roller 122 may also facilitate linear movement 130 of the secondary wellbore tubular 112 into and out of the inner volumes 105 and 109. In some aspects, the adjustable mount 118 that supports the secondary wellbore tubular 112 on the support surface 102 may be made of non-conductive material as well. In some aspects, movement of the secondary wellbore tubular 112 may be actuated by a human operator or a machine, such as a forklift or other machine.

As further shown in FIGS. 1A-1B, concentrically placed within an inner volume 113 of the secondary wellbore tubular 112 (as well as the inner volumes 105, 109, and 111) is another secondary wellbore tubular 114. In some aspects, the secondary wellbore tubular 114 is or replicates a production string (or wellbore liner) run into a wellbore within a production casing. As shown in this example, the secondary wellbore tubular 114 is radially centered in the inner volume 113 of the secondary wellbore tubular 112 by one or more wheels 124 that are positioned to contact both the secondary wellbore tubular 112 (for example, an inner surface of the secondary wellbore tubular 112) and the secondary wellbore tubular 114 (for example, an outer surface of the secondary wellbore tubular 114). Turning to FIG. 1B specifically, in this example implementation, three wheels 124 (spaced radially at 90° apart) are positioned to contact both the secondary wellbore tubular 112 and the secondary wellbore tubular 114. However, more wheels 124 may be used, or the wheels 124 may be positioned in different places, as FIG. 1B shows (in dashed line) different possible locations of the wheels 124 that separate the secondary wellbore tubular 112 and the secondary wellbore tubular 114.

The wheels 124, in this example, are sized to radially center (for example, on centerline 116) the secondary wellbore tubular 114 in the inner volume 113 (for example, to mimic a downhole configuration of such tubulars in a wellbore) as well as facilitate movement (for example, linear movement 130 of the secondary wellbore tubular 114 into and out of the inner volumes 105, 109, and 111, as well as rotation 128 of the secondary wellbore tubular 114 within the inner volume 113) of the secondary wellbore tubular 114. In some aspects, each of the wheels 124 that separate the secondary wellbore tubular 112 from the secondary wellbore tubular 114 may be made from a non-conductive material as well.

Turning to FIG. 1C, the alignment wheels 124, in this example, are sized to radially misalign the secondary wellbore tubular 114 in the inner volume 113 as well as facilitate movement (for example, linear movement 130 of the secondary wellbore tubular 114 into and out of the inner volumes 105, 109, and 111, as well as rotation 128 of the secondary wellbore tubular 114 within the inner volume 113) of the secondary wellbore tubular 114. In some aspects, each of the wheels 124 that separate the secondary wellbore tubular 110 from the secondary wellbore tubular 114 in FIG. 1C may be made from a non-conductive material as well.

As shown in FIG. 1A (and shown in dashed line in FIG. 1B), an adjustable mount 118 is positioned to support the secondary wellbore tubular 114 on the support surface 102 at an open end 141 of the secondary wellbore tubular 114. In some aspects, the adjustable mount 118 includes a structural member 120 coupled to the secondary wellbore tubular 110 and a roller 122 coupled to the structural member 120. The structural member 120 may be coupled to the secondary wellbore tubular 112 to facilitate rotation 128 of the secondary wellbore tubular 112 about the centerline 116 of the modular testing system 100. The roller 122 may also facilitate linear movement 130 of the secondary wellbore tubular 112 into and out of the inner volumes 105 and 109. In some aspects, the adjustable mount 118 that supports the secondary wellbore tubular 112 on the support surface 102 may be made of non-conductive material as well. In some aspects, movement of the secondary wellbore tubular 112 may be actuated by a human operator or a machine, such as a forklift or other machine.

Although four secondary wellbore tubulars 108, 110, 112, and 114 are shown in the example implementation of the modular testing system 100, other example implementations may have more or fewer secondary wellbore tubulars depending on, for instance, a design of downhole tubular system to be replicated by the modular testing system 100. For instance, to replicate a downhole tubular system that only has two casings and a production string, the primary wellbore tubular 104 and two secondary wellbore tubulars may be used. Further, in order to replicate the relative As shown in FIG. 1A, one or more of the adjustable mounts 118 that respectively support the secondary wellbore tubulars 108, 110, 112, and 114 may be adjustable in height as shown. For example, in FIG. 1A, the adjustable mount 118 that supports the secondary wellbore tubular 108 is shorter than the adjustable mount 118 that supports the secondary wellbore tubular 110, which in turn is shorter than the adjustable mount 118 that supports the secondary wellbore tubular 112, which in turn is shorter than the adjustable mount 118 that supports the secondary wellbore tubular 114. To adjust a height of the adjustable mount 118, in some aspects, a height (or length) of the respective structural member 120 may be adjusted.

As shown in FIGS. 1A-1C, these example implementations of the modular testing system 100 includes a rail 143 that is supported on or coupled to the support surface 102. In this example, the rollers 122 of the adjustable mounts 118 may ride on the rail 143 during movement 130 of the adjustable mounts 118 (and also the secondary wellbore tubulars). In some aspects, the rail 143 may align the rollers 122 and therefore the adjustable mounts 118 and secondary wellbore tubulars during movement 130.

As shown in FIG. 1A, one or more defects 126 may be formed on one or more of the wellbore tubulars (or within one or more cement portions). In some aspects, the defects 126 may be purposefully formed (in other words, man-made) on the wellbore tubulars (or cement portions, or both) prior to playing the secondary wellbore tubulars 108, 110, 112, and 114 into a concentric (or eccentric) position within the inner volume 105 of the primary wellbore tubular. The defects 126 may replicate, for example, longitudinal and transverse cracks, holes and pinholes, other generalized corrosion, or different degrees of internal and external metal loss (for example, square drill shape of specific width and depth in the tubular). Such defects 126 may be detectable by the logging tool 132 that is insertable into the secondary wellbore tubular 114.

As shown in FIGS. 1A-1C, the logging tool 132 may be inserted into an inner volume 115 of the secondary wellbore tubular 114. In some aspects, the logging tool 132 may be an EM logging tool that can measure, for example, electromagnetic, magnetic, sonic, ultrasonic, mechanical, or temperature characteristics of the primary wellbore tubular 104, as well as the secondary wellbore tubulars 108, 110, 112, and 114 as the logging tool 132 moves into and out of (in other words, linear movement 130) of the secondary wellbore tubular 114. Sensors within the logging tool 132 may also take or measure average and complete radial images of internal and external diameters of the primary and secondary wellbore tubulars, average and complete radial images of thicknesses of the primary and secondary wellbore tubulars, average and complete radial images of corrosion and scale of the primary and secondary wellbore tubulars, average and complete radial images of cement quality and bonding (through tubing applications) of the primary and secondary wellbore tubulars, ovalization of the primary and secondary wellbore tubulars, and eccentricity of the primary and secondary wellbore tubulars.

As shown in the example implementation of modular testing system 100, the logging tool 132 is communicably coupled (as shown by arrows 134), for example, through a wireline, to a control system 999. In some implementations, the control system 999 is a microprocessor-based control system that includes one or more hardware processors, one or more memory modules communicably coupled to the hardware processor(s), and instructions and data encoded on the one or more memory modules. The hardware processor(s) are operable to execute the instructions to perform operations, including operations described in the present disclosure. As shown in this example (for instance, by the bi-directional arrows 134), the control system 999 may be communicably coupled (wired or wirelessly) to the logging tool 132 to receive and process measurements taken from the logging tool 132 during operation within the secondary wellbore tubular 114. Such measurements taken by the logging tool 132 may be processed by the control system 999 in order to determine or characterize the known defects 126 in the modular testing system 100.

In some aspects, the control system 999 builds a machine learning model 990 based at least in part on measurements taken by the logging tool 132 within different configurations of the modular testing system 100 and the known, man-made defects 126 on the primary wellbore tubular 104 and the one or more secondary wellbore tubulars 108, 110, 112, and 114. In some aspects, a machine learning model 990 developed by the control system 999 may more accurately allow operators to characterize defects in wellbore tubulars in the field, in other words, within a wellbore drilled to produce hydrocarbons based on measurements taken for multiple different configurations of the modular testing system 100. The configurations may differ according to, for example, number of secondary wellbore tubulars, size or thickness of any particular wellbore tubular, concentric or eccentric position of any particular wellbore tubular relative to other wellbore tubulars, quantity or type of man-made defects on the wellbore tubulars, and other adjustable characteristics of the modular testing system 100.

In some aspects, multiple (for example, 10s, 100s, 1000s) tests may be performed with the modular testing system 100 with varying configurations to build the machine learning model 990. The modular testing system 100 may provide the flexibility and capability to perform the multiple tests, which include taking measurements for each test with the logging tool 132. Logging data can be acquired along different positions inside the secondary wellbore tubular 114 while varying the number of secondary wellbore tubulars, sizes of the pipes being exposed to the logging tool, number and type of defects 126, alignment of the defects from different tubulars, and the relative angle (azimuth) of the defects, among other adjustable characteristics. The measurements provide an input to the machine learning model 990 and are correlated to the known man-made defects 126 to provide an output of the machine learning model 990 that includes, for example, a spatial description and position of each particular defect 126 (for example, corrosion imaging and leak detection). A similar machine learning model for multiple cement sheaths evaluation may also be developed.

In some aspects, the machine learning model 990 is a deep learning model that employs multiple layers of models to generate an output for a received input. A deep neural network is a deep machine learning model that includes an output layer and one or more hidden layers that each apply a non-linear transformation to a received input to generate an output. In some cases, the neural network may be a recurrent neural network. A recurrent neural network is a neural network that receives an input sequence and generates an output sequence from the input sequence. In particular, a recurrent neural network uses some or all of the internal state of the network after processing a previous input in the input sequence to generate an output from the current input in the input sequence. In some other implementations, the machine learning model 990 is a convolutional neural network. In some implementations, the machine learning model 990 is an ensemble of models that may include all or a subset of the architectures described above.

In some implementations, the machine learning model 990 can be a feedforward autoencoder neural network. For example, the machine learning model 990 can be a three-layer autoencoder neural network. The machine learning model 990 may include an input layer, a hidden layer, and an output layer. In some implementations, the neural network has no recurrent connections between layers. Each layer of the neural network may be fully connected to the next, for example, there may be no pruning between the layers. The neural network may include an optimizer for training the network and computing updated layer weights, such as, but not limited to, ADAM, Adagrad, Adadelta, RMSprop, Stochastic Gradient Descent (SGD), or SGD with momentum. In some implementations, the neural network may apply a mathematical transformation, for example, a convolutional transformation or factor analysis to input data prior to feeding the input data to the network.

In some implementations, the machine learning model 990 can be a supervised model. For example, for each input provided to the model during training (for example, by the logging tool 132), the machine learning model 990 can be instructed as to what the correct output should be (for example, based on the known defects 126). The machine learning model 990 can use batch training, for example, training on a subset of examples before each adjustment, instead of the entire available set of examples. This may improve the efficiency of training the model and may improve the generalizability of the model. The machine learning model 990 may use folded cross-validation. For example, some fraction (the "fold") of the data available for training can be left out of training and used in a later testing phase to confirm how well the model generalizes. In some implementations, the machine learning model 990 may be an unsupervised model. For example, the model may adjust itself based on mathematical distances between examples rather than based on feedback on its performance.

A machine learning model 990 can be trained to recognize certain tubular defects when compared with the historical data. The machine learning model 990 can be, for example, a deep-learning neural network or a "very" deep-learning neural network. For example, the machine learning model 990 can be a convolutional neural network. The machine learning model 990 can be a recurrent network. The machine learning model 990 can have residual connections or dense connections. The machine learning model 990 can be an ensemble of all or a subset of these architectures. The machine learning model 990 is trained to determine one or more characteristics of a defects using the logging tool 132 based on detecting patterns from one or more of the presently measured logging data as well as a historical logging data set. The model may be trained in a supervised or unsupervised manner. In some examples, the model may be trained in an adversarial manner. In some examples, the machine learning model 990 may be trained using multiple objectives, loss functions or tasks.

Figure 2:
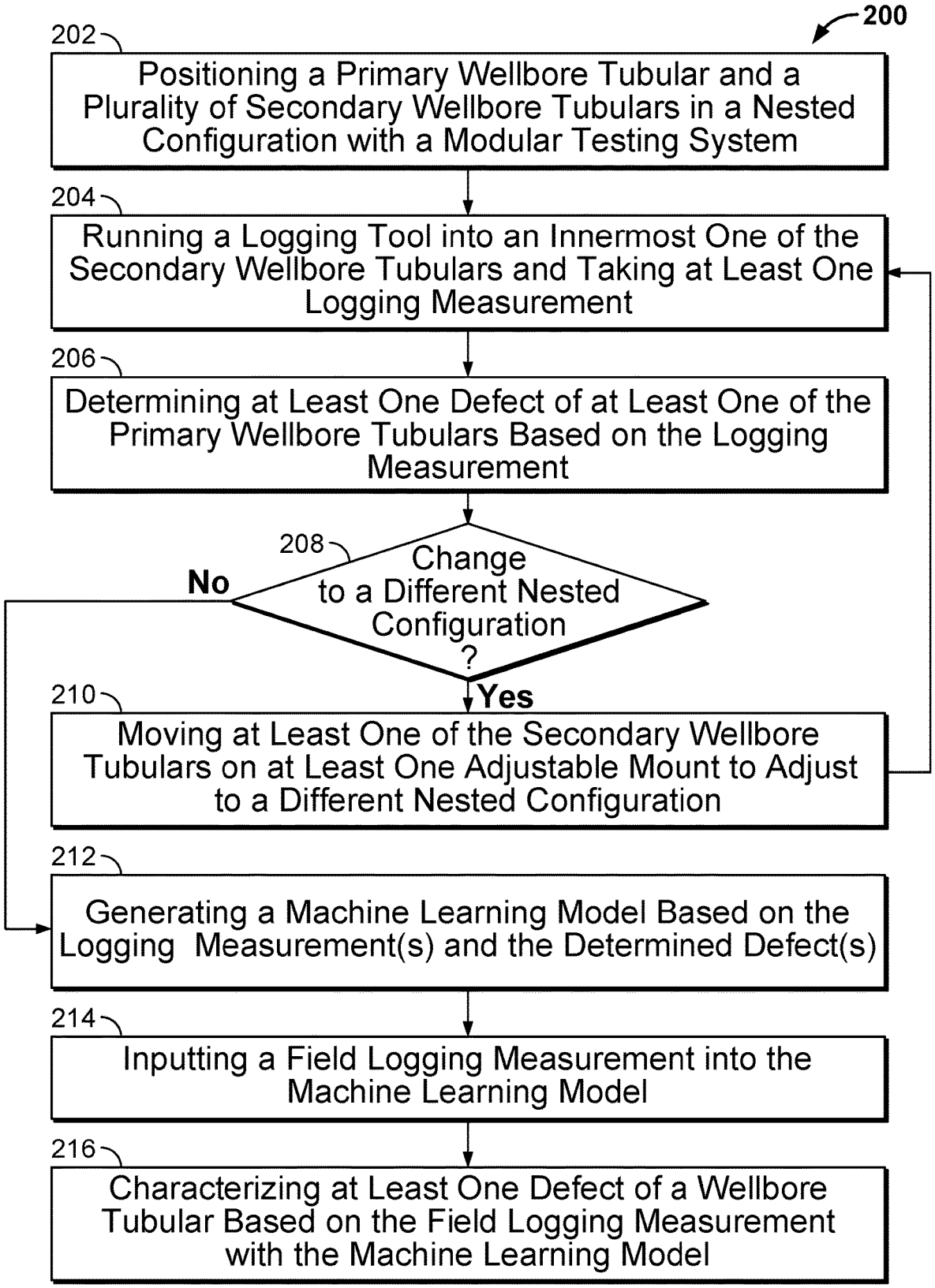
FIG. 2 is a flowchart that describes an example method performed with a modular testing system according to the present disclosure.

FIG. 2 is a flowchart that describes an example method 200 performed with a modular testing system, such as the modular testing system 100 shown in FIGS. 1A-1B. Method 200 may begin at step 202, which includes positioning a primary wellbore tubular and a plurality of secondary wellbore tubulars in a nested configuration with a modular testing system. For example, as shown in the example modular testing system 100, the primary (or fixed) wellbore tubular 104 is positioned on the one or more fixed mounts 106, while multiple secondary wellbore tubulars 108, 110, 112, and 114 are positioned in a nested configuration as shown in FIGS. 1A-1B. A particular nested configuration may be defined by, for example, a number of secondary wellbore tubulars that are nested within the primary wellbore tubular (as well as each other), a length of overlap of the wellbore tubulars in the nested configuration, a distance that separates each pair of adjacent wellbore tubulars (for example, by the alignment wheels), as well as a quantity or type (or both) of defects formed on the wellbore tubulars. In some aspects, the nested configuration may represent an as-built or proposed wellbore tubular system in a wellbore that extends from a terranean surface to a subterranean formation.

Method 200 may continue at step 204, which includes running a logging tool into an innermost one of the secondary wellbore tubulars and taking at least one logging measurement. For example, the logging tool 132 may be run into the secondary wellbore tubular 114 and, while moving within the secondary wellbore tubular 114, take logging measurements, such as electromagnetic, magnetic, sonic, ultrasonic, mechanical, or temperature measurements. In some aspects, the measurements may be imagery measurements, such as complete radial images of internal and external diameters of the primary and secondary wellbore tubulars, average and complete radial images of thicknesses of the primary and secondary wellbore tubulars, average and complete radial images of corrosion and scale of the primary and secondary wellbore tubulars, average and complete radial images of cement quality and bonding (through tubing applications) of the primary and secondary wellbore tubulars, ovalization of the primary and secondary wellbore tubulars, and eccentricity of the primary and secondary wellbore tubulars. The measurements taken by the logging tool 132 may be transmitted (for example, by a wireline) to the control system 999 of the modular testing system 100.

Method 200 may continue at step 206, which includes determining at least one defect of at least one of the primary wellbore tubular or secondary wellbore tubulars based on the logging measurement. For example, the control system 999 may use one or more of the measurements taken by the logging tool 132 to determine, for example, a location of one or more defects, such as on which particular wellbore tubular and at which location on the particular wellbore tubular the defect is located. Also, the control system 999 may use one or more of the measurements taken by the logging tool 132 to determine, for example, a type of the located defects. The defect may be, for example, a hole or crack, or portion of the tubular (which is usually steel) that has corroded. In some aspects, the defects are man-made and formed on the particular wellbore tubulars.

Method 200 may continue at step 208, which includes a decision of whether to change the nested configuration to a different nested configuration. For example, multiple tests with the logging tool 132 at many (10s, 100s, 1000s) different nested configurations may be desirable in order to, for example, build a database or machine learning model that can be used to predict defects in field installed wellbore tubular systems. As another aspects, a particular logging tool may be tested (for example, for development or prototyping purposes) at many (10s, 100s, 1000s) different nested configurations.

Thus, if an additional test at a different nested configuration is desired ("yes") at step 208, then method 200 may continue at step 210, which includes moving at least one of the secondary wellbore tubulars on at least one adjustable mount to adjust to a different nested configuration. For example, as shown in FIGS. 1A-1B, each of the secondary wellbore tubulars 108, 110, 112, and 114 is moveable in two directions (shown by linear movement 130) as well as rotatable (shown by rotation 128) to adjust the nested configuration of the modular testing system 100. For example, by adjusting one or more of the secondary wellbore tubulars into or out of the nested configuration (in one of the directions of linear movement 130), an amount of overlap between adjacent wellbore tubulars may be adjusted. By rotating 128 (as well as linearly movement 130) one or more of the secondary wellbore tubulars, a position of one or more defects may be changed. Other steps to adjust the nested configuration may also include removing or adding one or more secondary wellbore tubulars from or to the modular testing system 100. From step 210, method 200 may return to step 204 and steps 204 and 206 may be repeated. As is understood, this loop of steps 208 to 210 to 204 to 206 may be repeated as many times as desired to procure logging measurements from as many unique nested configurations as so desired.

If an additional test at a different nested configuration is not desired ("no") at step 208, then method 200 may continue at step 212, which includes generating a machine learning model based on the logging measurement(s) and the determined defect(s). For example, multiple (for example, 10s, 100s, 1000s) tests may be performed with the modular testing system 100 with varying configurations to build the machine learning model 990. The logging data is acquired along different positions inside the secondary wellbore tubular 114 while varying the number of secondary wellbore tubulars, sizes of the pipes being exposed to the logging tool, number and type of defects 126, alignment of the defects from different tubulars, and the relative angle (azimuth) of the defects, among other adjustable characteristics. Such measurements provide an input to the machine learning model 990 and are correlated to the known man-made defects 126 to provide an output of the machine learning model 990 that includes, for example, a spatial description and position of each particular defect 126 (for example, corrosion imaging and leak detection).

Method 200 may continue at step 214, which includes inputting a field logging measurement into the machine learning model. For example, once the machine learning model is generated, actual field logging measurements (in other words, measurements taken by a logging tool that is similar to or the same as the logging tool 132 within a wellbore tubular system installed in a wellbore) may be used as inputs into the machine learning model 990. Generally, and as previously described, the machine learning model 990 is trained on the logging measurements taken in multiple different nested configurations of the modular testing system 100 and correlated to the known defects 126 formed on the one or more wellbore tubulars.

Method 200 may continue at step 216, which includes characterizing at least one defect of a wellbore tubular based on the field logging measurement with the machine learning model. For example, once trained on such a corpus of data (in other words, all of the tests from the multiple different nested configurations), the machine learning model 990 may thus characterize wellbore tubular defects based on input logging measurements. Such characterizations may provide a reliable technique to determine if one or more wellbore tubulars in a wellbore system positioned in a wellbore actually has a defect without requiring such tubular to be removed from the wellbore.

Method 200 may include other steps not specifically shown in FIG. 2. For example, logging measurements may be displayed on a graphical user interface (GUI) of the control system 999. Characterized defects may also be displayed on a graphical user interface (GUI) of the control system 999. In some aspects, movement of one or more of the secondary well tubulars (linear movement or rotation, or both) may be automated by the control system 999 and implemented by one or more automated machines (for example, automated forklifts or lifting machines) to move the one or more secondary wellbore tubulars.

Figure 3:
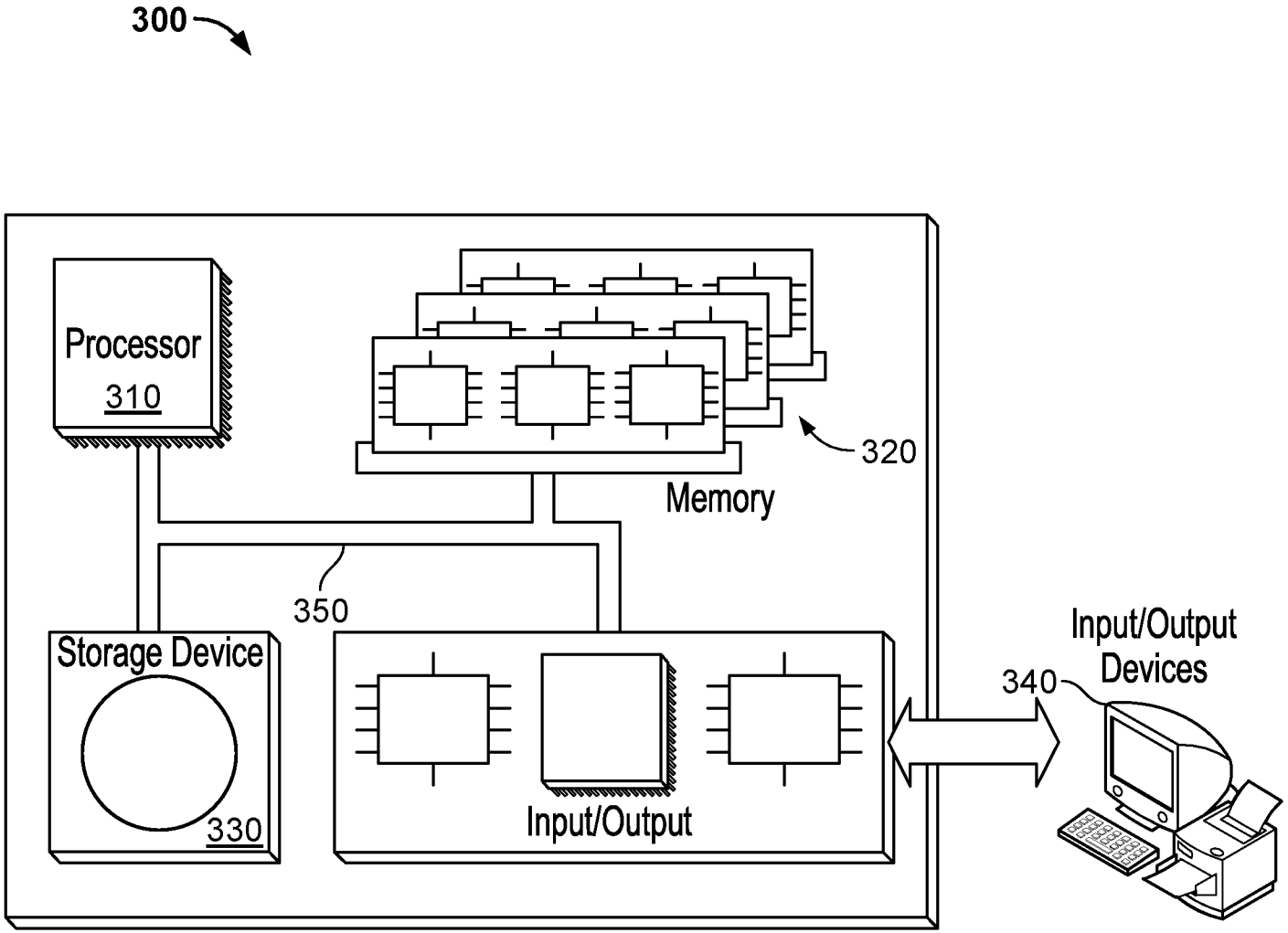
FIG. 3 is a schematic illustration of an example controller (or control system) for controlling operations of a modular testing system according to the present disclosure.

FIG. 3 is a schematic illustration of an example controller 300 (or control system) for controlling operations of a modular testing system according to the present disclosure. For example, the controller 300 may include or be part of the control system 999 shown in FIGS. 1A-1B. The controller 300 is intended to include various forms of digital computers, such as printed circuit boards (PCB), processors, digital circuitry, or otherwise that is part of a vehicle. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 300 includes a processor 310, a memory 320, a storage device 330, and an input/output device 340. Each of the components 310, 320, 330, and 340 are interconnected using a system bus 350. The processor 310 is capable of processing instructions for execution within the controller 300. The processor may be designed using any of a number of architectures. For example, the processor 310 may be a CISC (Complex Instruction Set Computers) processor, a RISC (Reduced Instruction Set Computer) processor, or a MISC (Minimal Instruction Set Computer) processor.

In one implementation, the processor 310 is a single-threaded processor. In another implementation, the processor 310 is a multi-threaded processor. The processor 310 is capable of processing instructions stored in the memory 320 or on the storage device 330 to display graphical information for a user interface on the input/output device 340.

The memory 320 stores information within the controller 300. In one implementation, the memory 320 is a computer-readable medium. In one implementation, the memory 320 is a volatile memory unit. In another implementation, the memory 320 is a non-volatile memory unit.

The storage device 330 is capable of providing mass storage for the controller 300. In one implementation, the storage device 330 is a computer-readable medium. In various different implementations, the storage device 330 may be a floppy disk device, a hard disk device, an optical disk device, or a tape device.

The input/output device 340 provides input/output operations for the controller 300. In one implementation, the input/output device 340 includes a keyboard or pointing device. In another implementation, the input/output device 340 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer. Additionally, such activities can be implemented via touch-screen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A modular testing system, comprising:

a primary wellbore tubular that comprises at least one open end and an inner volume;

at least one fixed mount configured to couple to the primary wellbore tubular and support the primary wellbore tubular on a support surface in a fixed position against movement relative to the support surface;

at least one secondary wellbore tubular sized to fit within the inner volume of the primary wellbore tubular;

at least one adjustable stand configured to couple to the at least one secondary wellbore tubular and support the at least one secondary wellbore tubular on the support surface, the at least one adjustable stand comprising a roller coupled to an end of the at least one adjustable stand and configured to move the at least one secondary wellbore tubular through the inner volume of the primary wellbore tubular; and a logging tool positionable within an inner volume of the at least one secondary wellbore tubular and configured to detect at least one defect of at least one of the primary wellbore tubular or the at least one secondary wellbore tubular.

2. The modular testing system of claim 1, further comprising at least one wheel positionable to contact an inner surface of the primary wellbore tubular and an outer surface of the at least one secondary wellbore tubular, the at least one wheel configured to move the at least one secondary wellbore tubular through the inner volume of the primary wellbore tubular.

3. The modular testing system of claim 2, wherein the at least one adjustable stand is coupled to the at least one secondary wellbore tubular at or near a first open end of the at least one secondary wellbore tubular, and the at least one wheel contacts the at least one secondary wellbore tubular at or near a second open end of the at least one secondary wellbore tubular opposite the first open end.

4. The modular testing system of claim 1, wherein the at least one secondary wellbore tubular comprises a first secondary wellbore tubular and a second secondary wellbore tubular, and the at least one adjustable stand comprises a first adjustable stand having a first roller and a second adjustable stand having a second roller.

5. The modular testing system of claim 4, wherein the first secondary wellbore tubular is sized to fit within the inner volume of the primary wellbore tubular, and the second secondary wellbore tubular is sized to fit within an inner volume of the first secondary tubular.

6. The modular testing system of claim 5, wherein the logging tool is positionable within the inner volume of the second secondary wellbore tubular and is configured to detect at least one defect of at least one of the primary wellbore tubular, the first secondary wellbore tubular, or the second secondary wellbore tubular.

7. The modular testing system of claim 5, wherein the second roller of the second adjustable stand is configured to move the second secondary wellbore tubular through the inner volume of the first secondary wellbore tubular.

8. The modular testing system of claim 5, further comprising:

a first wheel positionable to contact an inner surface of the primary wellbore tubular and an outer surface of the first secondary wellbore tubular, the first wheel configured to move the first secondary wellbore tubular through the inner volume of the primary wellbore tubular; and a second wheel positionable to contact an inner surface of the first secondary wellbore tubular and an outer surface of the second secondary wellbore tubular, the second wheel configured to move the second secondary wellbore tubular through the inner volumes of the first secondary wellbore tubular and the primary wellbore tubular.

9. The modular testing system of claim 8, wherein the first wheel comprises a plurality of first wheels positionable to contact the inner surface of the primary wellbore tubular and the outer surface of the first secondary wellbore tubular and sized to radially center the first secondary wellbore tubular within the inner volume of the primary wellbore tubular, and the second wheel comprises a plurality of second wheels positionable to contact the inner surface of the first secondary wellbore tubular and the outer surface of the second secondary wellbore tubular and sized to radially center the second secondary wellbore tubular within the inner volume of the primary wellbore tubular and the first secondary wellbore tubular.

10. The modular testing system of claim 1, wherein the at least one adjustable stand comprises a structural member coupled to the roller and the at least one secondary wellbore tubular, the structural member having an adjustable length.

11. A method for testing a wellbore tubular system, comprising:

positioning a primary wellbore tubular that comprises at least one open end and an inner volume on at least one fixed mount positioned to support the primary wellbore tubular on a support surface in a fixed position against movement relative to the support surface;

positioning at least one secondary wellbore tubular concentrically or eccentrically within at least a portion of the inner volume of the primary wellbore tubular;

coupling the at least one secondary wellbore tubular on at least one adjustable stand positioned to support the at least one secondary wellbore tubular on the support surface;

running a logging tool within an inner volume of the at least one secondary wellbore tubular;

detecting at least one defect of at least one of the primary wellbore tubular or the at least one secondary wellbore tubular; and moving the at least one secondary wellbore tubular within the inner volume of the primary wellbore tubular on a roller of the at least one adjustable stand that is in contact with the support surface.

12. The method of claim 11, further comprising moving the at least one secondary wellbore tubular through the inner volume of the primary wellbore tubular on at least one wheel positioned to contact an inner surface of the primary wellbore tubular and an outer surface of the at least one secondary wellbore tubular.

13. The method of claim 12, further comprising rotating the at least one secondary wellbore tubular within the inner volume of the primary wellbore tubular on the roller and the at least one wheel.

14. The method of claim 11, wherein the at least one secondary wellbore tubular comprises a first secondary wellbore tubular and a second secondary wellbore tubular, and the at least one adjustable stand comprises a first adjustable stand having a first roller and a second adjustable stand having a second roller, and moving the at least one secondary wellbore tubular within the inner volume of the primary wellbore tubular comprises at least one of:

moving the first secondary wellbore tubular within the inner volume of the primary wellbore tubular on the first roller of the first adjustable stand; or moving the second secondary wellbore tubular within the inner volume of the primary wellbore tubular and an inner volume of the first secondary wellbore tubular on the second roller of the second adjustable stand.

15. The method of claim 14, further comprising, simultaneously:

moving the first secondary wellbore tubular within the inner volume of the primary wellbore tubular on the first roller of the first adjustable stand; and moving the second secondary wellbore tubular within the inner volume of the primary wellbore tubular and an inner volume of the first secondary wellbore tubular on the second roller of the second adjustable stand.

16. The method of claim 15, further comprising:

running the logging tool within an inner volume of the second secondary wellbore tubular; and detecting at least one defect of at least one of the primary wellbore tubular, the first secondary wellbore tubular, or the second secondary wellbore tubular.

17. The method of claim 15, further comprising:

moving the first secondary wellbore tubular through the inner volume of the primary wellbore tubular on a first wheel positioned to contact an inner surface of the primary wellbore tubular and an outer surface of the first secondary wellbore tubular; and moving the second secondary wellbore tubular through the inner volume of the primary wellbore tubular and an inner volume of the first secondary wellbore tubular on a second wheel positioned to contact an inner surface of the first secondary wellbore tubular and an outer surface of the second secondary wellbore tubular.

18. The method of claim 17, wherein the first wheel comprises a plurality of first wheels and the second wheel comprises a plurality of second wheels, the method further comprising:

radially centering the first secondary wellbore tubular within the inner volume of the primary wellbore tubular on the plurality of first wheels; and radially centering the second secondary wellbore tubular within the inner volumes of the first secondary wellbore tubular and the primary wellbore tubular on the plurality of second wheels.

19. The method of claim 17, wherein the first wheel comprises a plurality of first wheels and the second wheel comprises a plurality of second wheels, the method further comprising:

eccentrically positioning the first secondary wellbore tubular within the inner volume of the primary wellbore tubular on the plurality of first wheels; and eccentrically positioning the second secondary wellbore tubular within the inner volumes of the first secondary wellbore tubular and the primary wellbore tubular on the plurality of second wheels.

20. The method of claim 14, further comprising at least one of:

installing a hardenable material in an annular space between the primary wellbore tubular and the first secondary wellbore tubular; or installing the hardenable material in an annular space between the first secondary wellbore tubular and the second secondary wellbore tubular.

21. The method of claim 20, further comprising:

running the logging tool within an inner volume of the second secondary wellbore tubular; and detecting at least one defect in at least one of the hardenable material installed in the annular space between the primary wellbore tubular and the first secondary wellbore tubular or the hardenable material installed in the annular space between the first secondary wellbore tubular and the second secondary wellbore tubular.

22. The method of claim 11, further comprising adjusting a height of the at least one adjustable stand to adjust a distance between the at least one secondary wellbore tubular and the support surface.

23. A wellbore tubular testing system, comprising:

a plurality of wellbore tubulars positioned in a nested configuration;

a stationary mount positioned in contact with a particular one of the plurality of wellbore tubulars and supported by a support surface in a fixed position;

at least one moveable mount positioned in contact with each of the other wellbore tubulars in the plurality of wellbore tubulars exclusive of the particular one of the plurality of wellbore tubulars, each moveable mount configured to move on the support surface to adjust a position of one of the other wellbore tubulars relative to the other wellbore tubulars;

a logging tool positionable within an innermost one of the plurality of wellbore tubulars in the nested configuration; and a control system communicably coupled to the logging tool and configured to perform operations comprising:

receiving at least one measurement from the logging tool as the logging tool moves within the innermost one of the plurality of wellbore tubulars in the nested configuration; and based on the at least one measurement, characterizing at least one defect formed on at least one of the plurality of wellbore tubulars.

24. The wellbore tubular testing system of claim 23, wherein the nested configuration comprises a first nested configuration, and the control system is configured to perform operations further comprising:

receiving at least another measurement from the logging tool as the logging tool moves within the innermost one of the plurality of wellbore tubulars in a second nested configuration different than the first nested configuration; and based on the at least another measurement, characterizing at least another defect formed on at least one of the plurality of wellbore tubulars.

25. The wellbore tubular testing system of claim 23, wherein the at least one measurement comprises at least one of: electromagnetic, magnetic, sonic, ultrasonic, mechanical, or temperature.

26. The wellbore tubular testing system of claim 23, wherein the at least one defect comprises at least one of a longitudinal crack, a transverse crack, a hole or pinhole, corrosion, or metal loss.

27. The wellbore tubular testing system of claim 23, wherein the operation of receiving the at least one measurement from the logging tool as the logging tool moves within the innermost one of the plurality of wellbore tubulars in the nested configuration comprises receiving at least one measurement from the logging tool as the logging tool moves within the innermost one of the plurality of wellbore tubulars for each of a plurality of unique nested configurations.

28. The wellbore tubular testing system of claim 27, wherein the operation of characterizing the at least one defect formed on at least one of the plurality of wellbore tubulars comprises characterizing at least one defect formed on at least one of the plurality of wellbore tubulars based on the at least one measurement from the logging tool as the logging tool moves within the innermost one of the plurality of wellbore tubulars for each of the plurality of unique nested configurations.

29. The wellbore tubular testing system of claim 28, wherein the control system is configured to perform operations further comprising generating a machine learning model based on the at least one measurement for each of the plurality of unique nested configurations and the characterized at least one defect for each of the plurality of unique nested configurations.

30. The wellbore tubular testing system of claim 29, wherein the control system is configured to perform operations further comprising:

receiving at least one logging measurement from a wellbore tubular system formed in a wellbore from a terranean surface to a subterranean formation, the wellbore tubular system comprising a plurality of wellbore tubulars; and using the machine learning model, characterizing one or more defects in the wellbore tubular system based on the at least one logging measurement.

31. The wellbore tubular testing system of claim 23, wherein at least one of the plurality of wellbore tubulars is positioned eccentrically relative to at least another one of the plurality of wellbore tubulars in the nested configuration.

* * * * *